United States Patent [19]

Johnson et al.

[11] Patent Number: 4,777,766

[45] Date of Patent: Oct. 18, 1988

[54] WINDOW REGULATOR FOR A CURVED WINDOW

[75] Inventors: Kenneth M. Johnson, Rochester Hills; Steven W. Bauer, Utica; Ronald N. Wilkie; Larry R. Smith, both of New Baltimore; Frederic R. Adams, Troy, all of Mich.

[73] Assignee: Saturn Corporation, Troy, Mich.

[21] Appl. No.: 37,181

[22] Filed: Apr. 10, 1987

[51] Int. Cl.[4] ..... E05F 11/46

[52] U.S. Cl. ..... 49/351; 49/375

[58] Field of Search ..... 49/349, 350, 351, 227, 49/359, 146, 348, 375

[56] References Cited

U.S. PATENT DOCUMENTS

| | | | |
|---|---|---|---|
| 3,591,982 | 7/1971 | Nantau | 45/50 |
| 3,783,702 | 1/1974 | Kondo | 49/349 |
| 3,842,541 | 10/1974 | Koike | 49/227 |
| 3,844,064 | 10/1974 | Yamaha et al. | 49/227 |
| 3,925,931 | 12/1975 | Ladd et al. | 49/227 |
| 3,925,932 | 12/1975 | Ladd | 49/227 |
| 4,069,616 | 1/1978 | Doveinis | 49/349 |
| 4,098,134 | 7/1978 | Kondo | 49/227 |
| 4,106,353 | 8/1978 | Kondo | 49/227 |

*Primary Examiner*—Kenneth J. Dorner
*Assistant Examiner*—Gerald A. Anderson
*Attorney, Agent, or Firm*—Ernest E. Helms

[57] ABSTRACT

The present invention provides a vehicle window regulator for curved windows. The present invention reduces the deflection of the sector arms of the window regulator allowing the use of lighter materials in the regulator components and also allowing the window to be placed into a thinner door panel enclosure than that previously allowable.

6 Claims, 2 Drawing Sheets

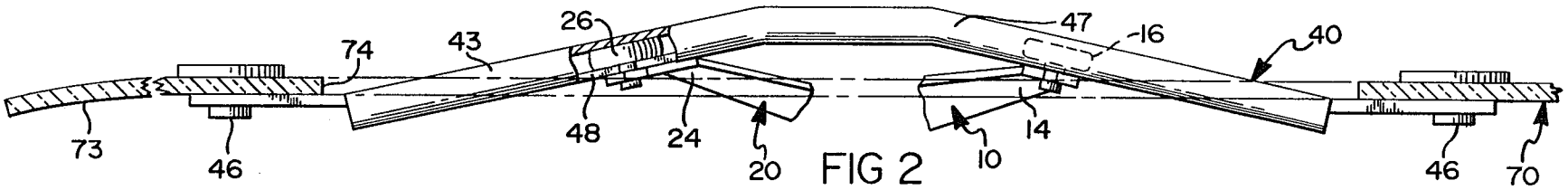
FIG 2
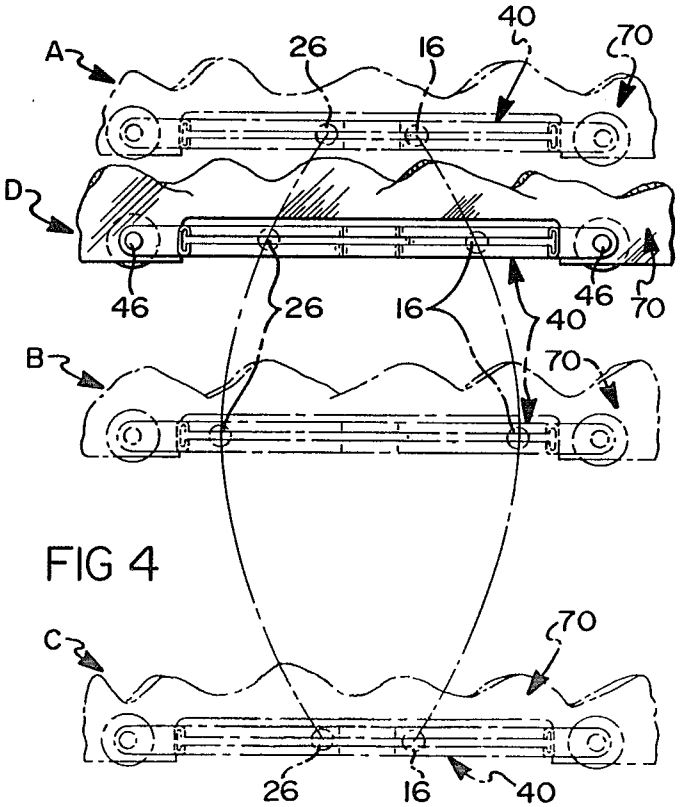
FIG 4
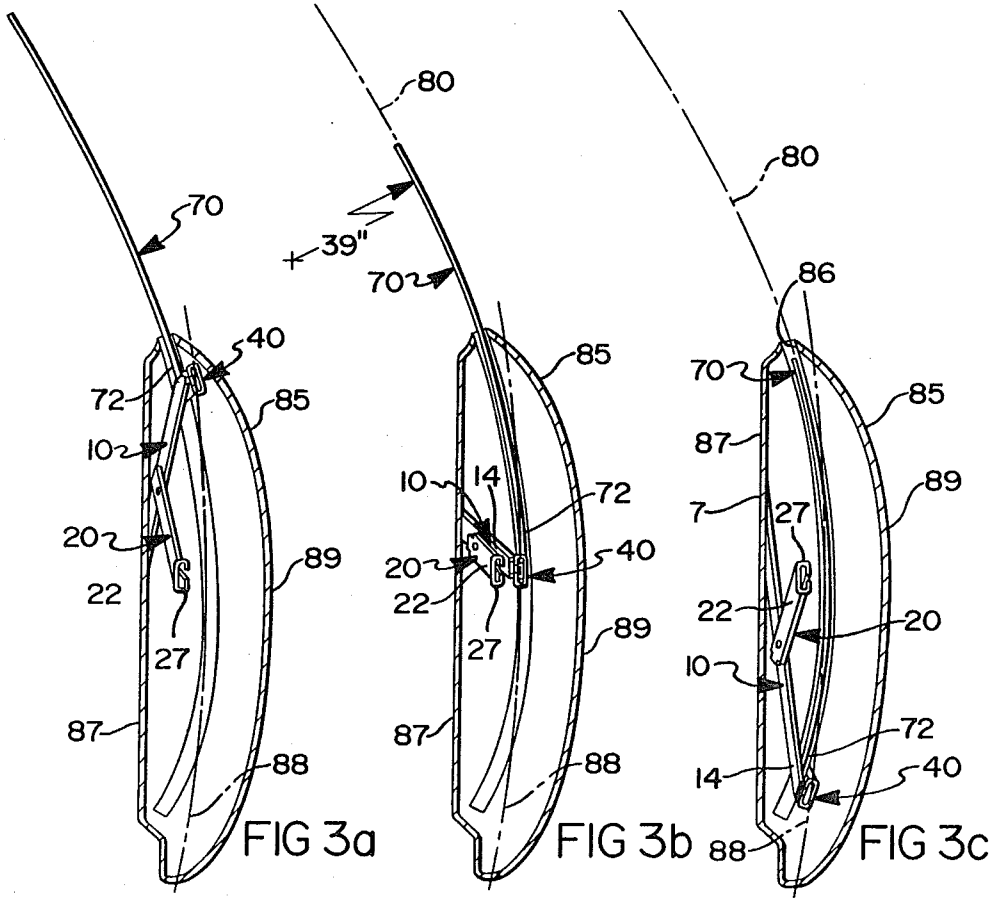
FIG 3c
FIG 3b
FIG 3a

WINDOW REGULATOR FOR A CURVED WINDOW

FIELD OF THE INVENTION

The field of the present invention is that of vehicle window regulators. More particularly the field of the present invention is that of vehicle door window regulators wherein the window glass has a relatively short radius of curvature.

DISCLOSURE STATEMENT

The use of cross arm sector window regulators in vehicle doors is well known in the art. An example of such a window regulator is illustrated and explained in U.S. Pat. No. 4,069,616, commonly assigned.

Due to aerodynamic and styling considerations, an increasing number of vehicle designs provide for door windows utilizing a window glass 51 (FIG. 5) which is vertically curved. The window glass 51 has a center of curvature 58 which is positioned towards the interior of the vehicle. When utilizing a sector arm type window regulator 52 with a curved glass 51, the sector arm 53 (only one shown for clarity of illustration) must deflect in the direction generally transverse to the direction of travel of the window. Deflection is usually defined as the differential of the distance of the end of the sector arm 53 from the inner wall 57 of the door panel 55. The above noted deflection 54 adds to the stress experienced by the sector arm 53 and significantly contributes to the determination of the transverse dimension of the vehicle door panel 55 (distance between inner and outer walls 57 and 59). It is desirable to provide a sector arm type window regulator which does not experience as great a deflection as those which are currently available. The reduction in deflection will allow the sector arm to experience less stress thereby being able to utilize lighter materials. Also, a decrease or elimination of the deflection of the sector arm will allow a reduction in the transverse dimension of the window glass space envelope (door panel).

SUMMARY OF THE INVENTION

To meet the above noted and other desires the present invention is brought forth. The present invention provides a curved glass vehicle window regulator utilizing a first and second sector arms pivotally mounted with respect to the vehicle and pivotally connected to each other. Also included are a winder mechanism to pivot the first sector arm, and a curved sash fixably attached to the window being bow shaped such that a line trace by the ends of the sector arms connected with the window is more linear than the curvilinear path taken by the window as the window is regulated between two extreme positions.

It is an object of the present invention to provide an apparatus and a method of utilization of the same of a curved window regulator for regulating a window along a curvilinear path between two extreme positions. It is also an object of the present invention to provide a window regulator usable in a vehicle door having a curved window wherein the transverse dimension of the vehicle door can be lessened in relationship to vehicle doors utilizing conventional window regulators.

It is an object of the present invention to provide a vehicle door window regulator for moving a curved window having a radius of curvature of 40 inches or less with a first end having a cut out through a door panel opening along a curvilinear path to a plurality of positions between extreme opposite positions with respect to the door panel opening, the regulator including a first sector arm with a first end pivotally connected with the vehicle and a second end with a rotatively connected roller, a second sector arm with a first end pivotally connected to a slider which is relatively mounted in a track fixed to the vehicle and a second end with a rotatively mounted roller and the second sector arm being pivotally connected with the first sector arm between the second sector arm first and second ends, a winder mechanism for pivotally moving the first sector arm, and a bow shaped sash connected adjacent the first end of the window projecting into the cutout of the window, the sash relatively mounting the first and second sector arm rollers whereby the lines traced by the second ends of the first and second sector arms as the window is moved between the extreme positions is generally straighter than the curvilinear path.

It is another object of the present invention to provide a method of regulating a curved vehicle window through a fixed opening along a curvilinear path to a plurality of positions between two extreme opposite positions with respect to the fixed opening including pivotally mounting with respect to the vehicle a first sector arm having first and second ends along the first sector arms first end, pivotally mounting with respect to the vehicle a second sector arm having first and second ends along the second sector arms first end, pivotally connecting the second sector arm to the first sector arm between the second sector arm first and second ends, relatively mounting the second ends of the first and second sector arms in a bow shaped sash, connecting the sash with the window, and angularly moving the first sector arm whereby the second end of the first sector arm traces a path generally more linear than the curvilinear path of the curved window.

Other objects, desires and advantages of the present invention will become more apparent to those skilled in the art as the nature of the invention is better understood from accompanying drawings and a detailed description.

BRIEF DESCRIPTION OF THE DRAWINGS

FIG. 2 a sectional view taken along line 2—2 of FIG. 1;

FIGS. 3A, 3B and 3C are side elevational views of the window regulator of the present invention in a sectioned door panel with portions of the regulator removed for clarity of illustration;

FIG. 4 is a front elevational view of the sash of the window regulator of the present invention in various positions.

DETAILED DESCRIPTION OF THE DRAWINGS

Figures 1, 5:
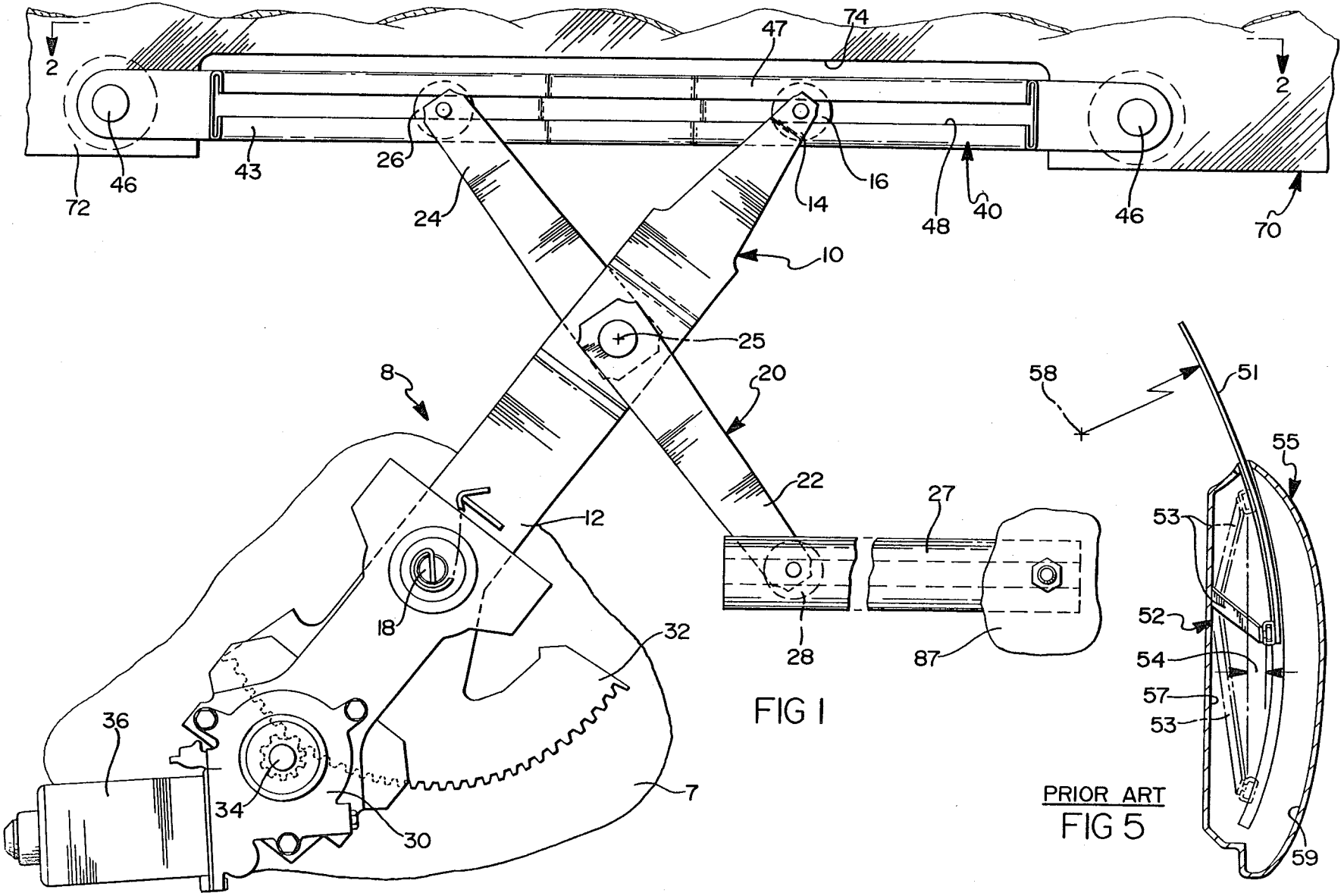
PRIOR ART FIG 5
FIG. 1 is a front elevational view of a preferred embodiment window regulator of the present invention in the enviroment of a vehicle door.
FIG. 5 is a side elevational view of a window regulator prior to the present invention in a sectioned door panel with portions of the regulator removed for clarity of illustration.

Referring to FIGS. 1, and 2, the window regulator 8 of the present invention has four major components. The first two components are the first 10 and second 20 sector arms which are pivotally mounted with respect to the vehicle 7 and pivotally connected with one another. An artificially or manually powered winder 30 provides the third element of the present invention which is the means to pivotally move the first sector arm 10. Relatively mounting the ends of the sector arms is a sash 40, the fourth major element of the window regulator 8 of the present invention. The sash 40 is bow shaped as will be described later.

The first sector arm 10 has a first end 12 and a second end 14. The first end 12 of the first sector arm is pivotally mounted with respect to the vehicle along pivot pin 18. First sector arm 10 is fixably connected with sector gear 32. Sector gear 32 meshes with a pinion 34 which is driven by an electric winder 36. The first sector arm second end 14 has rotatably mounted thereto a roller 16.

The second sector arm 20 is pivotally mounted with respect to the vehicle 7 via inner door wall 87. Sector arm 20 first end 22 is pivotally connected with a slider (roller 28) which is relatively mounted in track 27. Track 27 is fixably connected with the inner door wall 87. Second sector arm 20 has a second end 24 with a rotatably mounted roller 26. Second sector arm 20 is pivotally connected at point 25 between its first 22 and second 24 ends with the first sector arm 10.

The window glass 70 has a first end 72. Connected with the window glass 70 adjacent the first end 72 is the sash 40. The sash 40 is primarily shaped as an elongated C-channel having an opening 48 towards the interior of the vehicle. The sash 40 relatively mounts rollers 16 and 26 of the first and second sector arms. It is apparent to those skilled in the art that the rollers can be replaced with sliders, slidably mounted within the sash 40. The opposite ends of the sash 40 is preferably connected with the inboard surface of the glass 70 by rivets 46. The sash 40 has an bow shape portion 43 projecting outwardly into a cutout 74 of the window glass outboard of the window glass 70.

The window glass 70 has an inboard curvature towards the interior of the vehicle usually having a radius of curvature equal to or less than 40". However, the window regulator 8 of the present invention can also be highly useful with window glass with radius of curvatures exceeding 40". Line 80 illustrates the curvilinear path that window glass 70 travels as it is raised and lowered between the extreme up (closed) and down (open) positions. Line 80 is essentially coterminous with the window glass 70 in the raised and lowered position. The path traced by first end 72 will essentially be coterminous with the curvature of the window glass 70 in the lowered position.

In operation when the window glass 70 is at the lowermost position, the rollers 16 and 26 are positioned toward the middle of the sash 40 (FIGS. 3C and 4 position C) and therefore are in a position outboard (towards outer wall 89) of the vehicle window glass 70. As the vehicle window glass 70 is regulated upward towards the midpoint position (FIGS. 3B and 4B), window glass 70 penetrates the fixed opening 86 of the door panel 85, and the rollers 16 and 26 move horizontally outward within sash 40. At the midpoint of travel (FIG. 3B) the rollers 16 and 26 have traveled past the position of vertical alignment with the glass 70 and are slightly inboard almost co-planar with window glass 70.

As the window glass 70 is raised towards to a position as shown in FIGS. 1, 2 and 4 position D from the position of FIG. 4B, the rollers 16 and 26 again move to a position vertically aligned with window glass 70 and beyond in an outboard direction away from window travel path 80 towards the outer wall 89 of the door panel 7. At the same time rollers 16 and 26 are moving horizontally within sash 40 towards the sash center 47. As the window glass 70 is raised to its extreme up position (FIGS. 3A and 4A), the rollers 16 and 26 move even closer to one another within sash 40 and move still further away in an outboard direction from window travel path 80. Line 88 is a vertical projection tracing the travel of rollers 16 and 26 as the window glass 70 is translated up and down. Line 88 will be nearly a straight line or an arc with a far greater radius of curvature than that of window travel path 80 (window glass 70).

Since deflection (the change in distance of the rollers 16 and 26 from inner wall 87) of the rollers 16 and 26 is eliminated or significantly diminished, outer wall 89 can be designed to be closer to inner wall 87 providing a thinner door panel 85. The decrease in deflection also lowers the strength requirements of the sector arms 10 and 20, thereby allowing the use of lighter materials.

Window glass 70 has a compound curvature provided by edge 73 which bends inwards towards the inner panel 87. In most instances sash 40 will not have to be modified for slight compound curvatures, however, if required portion 43 of the sash can be modified to prevent roller 26 from experiencing greater deflection than roller 16 from the effect of the edge 73 of the window glass.

The present invention provides a method of regulating a curved window through a vehicle fixed opening 86 along a curvilinear path 80 to a plurality of positions between extreme opposite positions with respect to the fixed opening 86 including the following steps:

1. Pivotally mounting with respect to the vehicle 7 a first sector arm 10, having first 12 and second 14 ends, along the first sector arms 10 first end 12;

2. Pivotally mounting with respect to the vehicle 7 a second sector arm 20 having first 22 and second 24 ends along the second sector arms first 22 end;

3. Pivotally connecting the second sector arm 20 to the first sector arm 10 between the second sector arm 20 first 22 and second 24 ends arm;

4. Relatively mounting the second ends 14, 24 of the first and second sector arms in a bow shaped sash 40;

5. Connecting the sash 40 with the window 70; and

6. Angularly moving 30 the first sector arm 10 whereby the second end 14 of the first sector arm traces a path 88 generally more linear than the curvilinear path 80 of the curved window.

While an embodiment of the present invention has been explained, it will be readily apparent to those skilled in the art of the various modifications which can be made to the present invention without departing from the spirit and scope of this application as it is encompassed by the following claims.

The embodiments of the invention in which an exclusive property or privilege is claimed are defined as follows:

1. A vehicle window regulator for moving an inboard curved window with a first end having a cut out through a fixed opening along a curvilinear path to a plurality of positions between extreme opposite positions with respect to said fixed opening, said regulator in combination comprising:

a first sector arm having first and second ends and having said first end pivotally mounted with respect to said vehicle;

a second sector arm having first and second ends, said first end being pivotally mounted with respect to said vehicle and said second sector arm being pivotally connected with said first sector arm between said second sector arm first and second ends;

means for pivotally moving said first sector arm; and a sash having an intermediate bow shaped portion, said sash having opposite ends connected adjacent an inboard surface of said first end of said window, said sash relatively mounting said second ends of said first and second sector arms, said sash bow shaped portion projecting outwardly into said cut out of said window outboard whereby a path traced by said second ends of said first and second sector arms as said window is moved between said extreme positions is generally a straighter path than said curvilinear path and said first and second ends are outboard of said window when said window is at said extreme positions and said sector arm ends in an intermediate position are generally vertically aligned with said window.

2. A window regulator as described in claim 1, wherein said first end of said second arm is pivotally connected with a slider which is relatively mounted in a track fixed with said vehicle.

3. A vehicle window regulator as described in claim 1, wherein the second end of said first and second sector arms have rotatably mounted thereto rollers.

4. A vehicle regulator for moving an inboard curved window having a radius of curvature of 40 inches or less with a first end with a first end having a cut out through a fixed opening along a curvilinear path to a plurality of positions between extreme opposite positions with respect to said fixed opening, said regulator in combination comprising:

a first sector arm having a first end pivotally connected with said vehicle and a second end with a rotatively connected roller;

a second sector arm having a first end being pivotally connected with a slider which is relatively mounted in a track fixed to said vehicle and said second sector arm having a second end with a rotatively mounted roller and said second sector arm being pivotally connected with said first sector arm between said second sector arm first and second ends;

a winder mechanism for pivotally moving said first sector arm; and a sash having an intermediate bow shaped portion, said sash having opposite ends connected adjacent an inboard surface of said first end of said window, said bow shaped portion projecting outwardly into said cut out of said window outboard of said window, said sash relatively mounting said first and second sector arm rollers whereby the paths traced by said second ends of said first and second sector arms as said window is moved between said extreme positions is generally straighter than said curvilinear path and said first and second rollers are outboard of said window when said window is at said extreme positions and said rollers in an intermediate position are generally vertically aligned with said window.

5. A vehicle door window regulator for moving an inboard curved window having a radius of curvature of 40 inches or less with a first end having a cut out through a door panel opening along a curvilinear path to a plurality of positions between extreme opposite positions with respect to said door panel opening, said regulator in combination comprising:

a first sector arm with a first end pivotally connected with said vehicle and a second end with a rotatively connected roller;

a second sector arm with a first end pivotally connected to a slider which is relatively mounted in a track fixed to said vehicle and a second end with a rotatively mounted roller and said second sector arm being pivotally connected with said first sector arm between said second sector arm first and second ends;

a winder mechanism for pivotally moving said first sector arm; and a sash having an intermediate bow shaped portion, said sash having opposite ends connected adjacent an inboard surface of said first end of said window, said bow shaped portion of said sash projecting outwardly into said cut out of said window outboard of said window, said sash relatively mounting said first and second sector arm rollers whereby the lines traced by said second ends of said first and second sector arms as said window is moved between said extreme positions is generally straighter than said curvilinear path and said first and second rollers are outboard of said window when said window is at said extreme positions and said rollers in an intermediate position are generally vertically aligned with said window.

6. A method of regulating an inboard curved vehicle window with a first end with a cut out through a fixed opening along a curvilinear path to a plurality of positions between two extreme opposite positions with respect to said fixed opening, said method in combination comprising:

pivotally mounting with respect to said vehicle a first sector arm, having first and second ends, said pivotal mounting being at said first sector arms first end;

pivotally mounting with respect to said vehicle a second sector arm, having first and second ends, along said second sector arms first end;

pivotally connecting said second sector arm to said first sector arm between said second sector arm first and second ends;

relatively mounting said second ends of said first and second sector arms with a sash with opposite ends and intermediate bow shaped portion;

connecting said opposite ends of said sash with an inboard surface of said first end of said window with said bow shaped portion projecting outwardly into said cut out of said window first end; and angularly moving said first sector arm whereby said second end of said first sector arm traces a path generally more linear than said curvilinear path of said curved window and said second ends of said first and second sector arms are outboard of said window when said window is at said extreme positions and said second ends in an intermediate position are generally vertically aligned with said window.

* * * * *